United States Patent [19]

Lew

[11] Patent Number: 4,586,742

[45] Date of Patent: May 6, 1986

[54] SANITARY RING PACKAGING

[76] Inventor: Jung G. Lew, 7890 Oak St., Arvada, Colo. 80005

[21] Appl. No.: 931,774

[22] Filed: Aug. 7, 1978

[51] Int. Cl.[4] ..... B65D 75/00; B65D 85/62

[52] U.S. Cl. ..... 294/87.2; 206/150

[58] Field of Search ..... 206/150, 151, 497, 432; 294/33, 87.2

[56] References Cited

U.S. PATENT DOCUMENTS 3,355,013 11/1963 Poupitch ..... 206/150

4,121,712 10/1978 Cunningham ..... 294/87.2

*Primary Examiner*—James B. Marbert

[57] ABSTRACT

In the present day marketing of the beer or soft drinks packaged in the cans, six cans are bound to one pack by a plastic sheet with six holes forcedly inserted around the top portion of the cans. Although said type of packaging is economic, it is less than completely sanitary. Most people drink the content in the can directly from the can without washing the can. In said packaging method of cans, the top of cans are completely exposed and often contaminated by dusts and other sources during the transportation, storage and display in the retail stores. As a consequence, the can tops are not clean for directly drinking from the can in said packaging method. The present invention discloses the method of incorporating a thin plastic sheet to said plastic packaging ring, which incorporation provides means for covering up the can tops.

5 Claims, 1 Drawing Figure

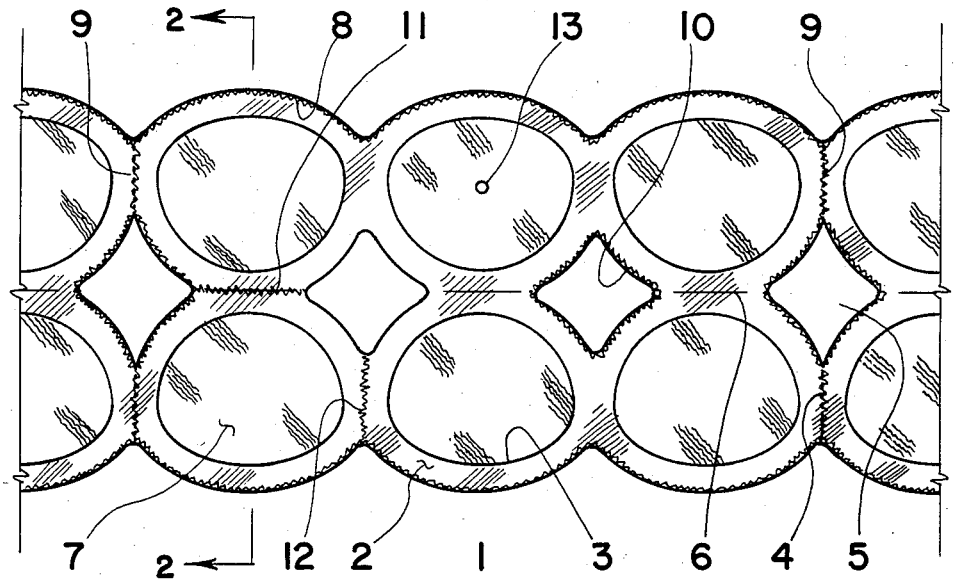
Fig. 1
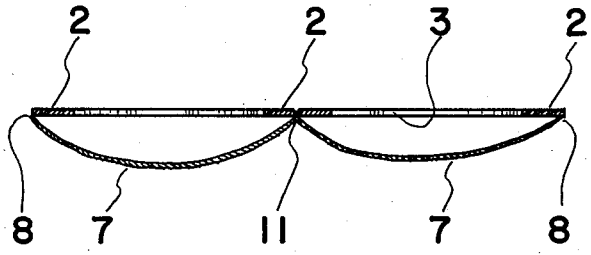
Fig. 2
Fig. 3
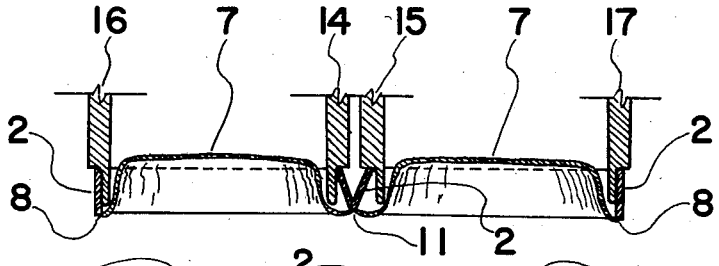
Fig. 4
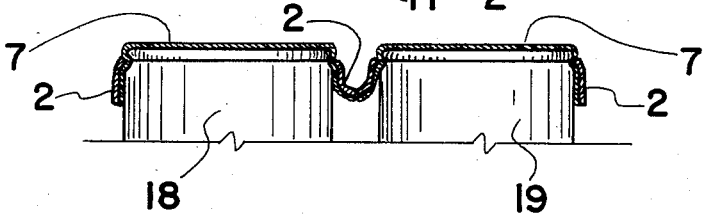

SANITARY RING PACKAGING

A large portion of the beer or soft drinks packaged in cans are sold in one type of six packs wherein six cans are bound together by a plastic sheet with six holes inserted around the top portion of cans. This method of binding cans is known by a commercial name "Hi-Cone". Although the so called "Hi-Cone" packaging of cans are economic and widely used in beer and soft drink industries, said packaging method is not sanitary in the sense that the can tops are completely exposed for contamination in said packaging method. Most people drink directly from the can without washing the can. The exposed can tops in "Hi-Cone" packaging is prone to contamination during transportation, storage and display for sale. Consequently, the clean condition of the can top required for drinking directly from the can is not preserved in the "Hi-Cone" packaging.

The primary object of the present invention is to provide the means for covering up the can tops in the plastic ring packaging of the cans.

A further object of the present invention is to provide the means of superimposing a thin plastic sheet to the plastic rings binding cans together, which thin plastic sheet covers up the can tops.

These and other objects of the present invention will become clear as the description of the present invention proceeds. The present invention may be described with greater clarity and specificity by referring to FIGS. 1, 2, 3 and 4.

FIG. 1 is a plan view of the invention.

FIG. 2 is a cross-section taken along line 2—2 of FIG. 1.

FIG. 3 is a cross-sectional view showing the invention being engaged by a handling mechanism to place the invention over a plurality of cans.

FIG. 4, partly in section, shows the invention in place securing a plurality of cans together.

In FIG. 1, there is shown a plan view of the "Sanitary Packaging Rings" 1 constructed in accordance with the principles taught by the present invention. The sanitary packaging rings 1 comprises a thick plastic sheet 2 having a plurality of near-circular holes 3 cut out and a thin plastic sheet 7 superimposed onto the thick plastic sheet 2. The both side edge of the thick plastic sheet 2 are contoured to conform with the near-circular holes 3. A series of diamond shaped cut-outs 5 are disposed intermediate every four of near-circular holes 3. As a consequence, the thick plastic sheet 2 is of the pattern having a series of the plastic rings connected together. The thin plastic sheet 7 has both side edge contoured to conform with the edges of the thick plastic sheet. The thick plastic sheet 2 and the thin plastic sheet 7 are bonded to each other along both side edges, which bonding is represented by a wavy line 8 in the illustration. Said bonding may be continuous or intermitent. The sanitary packaging rings may be made to a long strip, which can be separated into segments having four, six or eight holes for binding four, six or eight cans together, respectively. For a facile separation of the sanitary packaging rings of strip forms into sub-segments with four, six or eight holes, a series of stitch cuts 4 are provided, which stitch cuts tears apart when a small amount of tension is applied across said stitch cuts. A series of indentation 6 are disposed along the center line of the sanitary packaging rings to enhance the tight grouping of bound cans (see FIG. 4). The thin plastic sheet 7 may be further bonded to the thick plastic sheet 2 along the line of stitch cut 4, which bonding is represented by a wavy line 9 in the illustration. The thin plastic sheet 7 may be still further bonded to the thick plastic sheet 2 along the edge of the diamond shaped cut-outs 5, which bonding is represented by a wavy line 10 in the illustration. The thin plastic sheet 7 may be also bonded to the thick plastic sheet 2 along the boundary between adjacent near-circular holes 3, which bonding is represented by a wavy lines 11 and 12 in the illustration. Often the can tops are wet during the packaging process. In order to facilitate the drying of can tops after packaging them with the sanitary packaging rings 1, a small openings 13 through the thin plastic sheet 7 may be provided in the middle of each of the near-circular holes 3. Such a small openings 13 allows the moisture to escape, but does not provide any significant passage for the dusts to settle on the can top. A slitted opening may be employed in place of a circular opening.

In FIG. 2, there is shown a cross section of the sanitary packaging ring illustrated in FIG. 1, which cross section is taken along a plane as shown in FIG. 1. Here the lines of bonding 8 and 11 are specifically shown. It is also shown that the thin plastic sheet 7 has a greater width than the thick plastic sheet 2, of which necessity becomes obvious when FIGS. 3 and 4 are studied. In general, there must be sufficient area of the thin plastic sheet 7 within each of the near-circular holes 3 to cover up the top of cans when the top portion of the can is inserted into the near-circular hole 3 (see FIGS. 3 and 4).

There is shown in FIGS. 3 and 4 the same cross section of the sanitary packaging rings 1 as that of FIG. 2. In FIG. 3, it is illustrated that the ring openers 14 and 16, and 15 and 17 respectively engage two near-circular holes and temporarily enlarge them by stretching. It should be understood that said ring openers penetrate to a depth wherein the thin plastic sheet 7 is not punctured. The position of the thin plastic sheet shown in FIG. 3 is of the one created by the air blown up-wardly. In natural state, the thin plastic sheet 7 merely hangs down depending from the bonding lines 8 and 11. The enlarged near-circular holes opened up by the ring openers can readily inserted around the top portion of a can. Once the ring openers are retracted, the sanitary packaging shown in FIG. 4 results, wherein cans are bound together by the plastic rings of the thick plastic sheet 2 and the can tops are completely covered by the thin plastic sheet 7.

While the principles of the invention have now been made clear in an illustrative embodiment, there will be immediately obvious to those skilled in the art many modifications of the structures, arrangement, proportions, the elements, materials and components used in the practice of the invention which are particularly adapted for specific environments and operating requirements without departing from those principles.

I claim:

1. The sanitary packaging rings used in binding cans together, said sanitary packaging rings comprising:

(a) a thick plastic sheet having a plurality of near-circular shaped cut-outs disposed in the pattern of multiple rows, each of said near-circular shaped cut-outs being able to be enlarged by stretching and inserted around the cans in tight relationship; whereby, said thick plastic sheet having a plurality of near-circular shaped cut-outs binds a plurality of cans together;

(b) a thin plastic sheet superimposed to said thick plastic sheet wherein said two plastic sheets are bonded to each other along the outer edge of said thick plastic sheet; whereby, said thin plastic sheet covers the tops of the cans bound together by said thick plastic sheet; and (c) said combination of thick plastic sheet and thin plastic sheet made in a long strip having stitch cuts disposed at a regular interval intermediate adjacent said near-circular shaped cut-outs, along said stitch cuts said thin plastic sheet is further bonded to said thick plastic sheet; whereby, said sanitary packaging rings in a strip form can be separated into a plurality of sanitary packaging rings of shorter length.

2. The sanitary packaging rings used in binding cans together, said sanitary packaging rings comprising:

(a) a thick plastic sheet having a plurality of near-curcular shaped cut-outs disposed in the pattern of multiple rows, each of said near-circular shaped cut-outs being able to be enlarged by stretching and inserted around the cans in tight relationship; whereby, said thick plastic sheet having a plurality of near-circular shaped cut-outs binds a plurality of cans together;

(b) a thin plastic sheet superimposed to said thick plastic sheet wherein said two plastic sheets are bonded to each other along the outer edge of said thick plastic sheet; whereby, said thin plastic sheet covers the tops of the cans bound together by said thick plastic sheet;

(c) said combination of thick plastic sheet and thin plastic sheet made in a long strip having stitch cuts disposed at a regular interval intermediate adjacent said near-circular shaped cut-outs, along said stitch cuts said thin plastic sheet is further bonded to said thick plastic sheet: whereby, said sanitary packaging rings in a strip form can be separated into a plurality of sanitary packaging rings of shorter length; and (d) said combination of thick plastic sheet and thin plastic sheet including a small opening through said thin plastic sheet provided in each of said near-circular shaped cut-outs; whereby said small openings allows the moisture on the can tops to escape to the atmosphere.

* * * * *